US009122247B2

(12) United States Patent
Rombach

(10) Patent No.: US 9,122,247 B2
(45) Date of Patent: Sep. 1, 2015

(54) DATE DISPLAY DEVICE FOR A TIMEPIECE

(71) Applicant: ETA SA Manufacture Horlogere Suisse, Grenchen (CH)

(72) Inventor: Stefan Rombach, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/571,598

(22) Filed: Dec. 16, 2014

(65) Prior Publication Data

US 2015/0220063 A1 Aug. 6, 2015

(30) Foreign Application Priority Data

Jan. 31, 2014 (EP) ..... 14153395

(51) Int. Cl.
*G04B 19/247* (2006.01)
*G04B 19/253* (2006.01)

(52) U.S. Cl.
CPC ..... *G04B 19/25353* (2013.01); *G04B 19/247* (2013.01)

(58) Field of Classification Search
CPC ..... G04B 19/25353; G04B 19/24; G04B 19/247; G04B 19/2536; G04B 19/241
USPC ..... 368/28, 35–38
See application file for complete search history.

(56) References Cited

U.S. PATENT DOCUMENTS

| | | | | |
|---|---|---|---|---|
| 4,257,113 | A * | 3/1981 | Meister et al. | 368/35 |
| 6,735,151 | B2 * | 5/2004 | Triponez | 368/28 |
| 7,180,829 | B2 * | 2/2007 | Watanabe | 368/37 |
| 7,366,058 | B2 * | 4/2008 | Marki et al. | 368/220 |
| 7,724,611 | B2 * | 5/2010 | Groothuis et al. | 368/37 |
| 8,264,912 | B2 * | 9/2012 | Watanabe | 368/38 |
| 8,477,564 | B2 * | 7/2013 | Suzuki | 368/37 |
| 2010/0103780 | A1 | 4/2010 | Chaignat | |
| 2010/0188937 | A1 | 7/2010 | Watanabe | |

FOREIGN PATENT DOCUMENTS

| | | |
|---|---|---|
| EP | 1 296 204 A1 | 3/2003 |
| EP | 2 180 383 A1 | 4/2010 |
| EP | 2 230 575 A2 | 9/2010 |

OTHER PUBLICATIONS

European Search Report issued Sep. 30, 2014 in European Application 14153395, filed on Jan. 31, 2014 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Device for displaying a date indication in an aperture of a watch dial including:

a units indicator which carries on a periphery the ten individual numbers from "0" to "9" in a regularly spaced manner, each of the ten individual numbers being separated from the following individual number by an empty space or a display aperture arranged at the periphery of the units indicator;

a tens indicator which carries on a periphery a series of thirty-one regularly spaced numbers, namely nine times in a row the number "0", then ten times in a row the number "1", then ten times in a row the number "2", and finally two times in a row the number "3";

wherein the units indicator is arranged above the tens indicator, wherein the tens indicator advances one step per day and drives the units indicator forward by one step every day, except the day that the date indication display changes from "31" to "01".

17 Claims, 4 Drawing Sheets

DATE DISPLAY DEVICE FOR A TIMEPIECE

This application claims priority from European Patent Application No. 14153395.0 filed Jan. 31, 2014 the entire disclosure of which is incorporated herein by reference.

FIELD OF THE INVENTION

The present invention concerns a date display device for a timepiece. More specifically, the present invention concerns a device of this type particularly suited for a large date display.

BACKGROUND OF THE INVENTION

There are already a large number of known date display devices for timepieces. Usually, these date display devices are complex, involving a large number of components. Their cost price is therefore high and their operating reliability is not always ensured.

SUMMARY OF THE INVENTION

It is an object of the invention to overcome the aforementioned drawbacks by providing a date display device for a timepiece involving a limited number of components.

To this end, the present invention concerns a device for displaying a date indication in an aperture of a watch dial including:

- a units indicator which carries on a periphery the ten individual numbers from "0" to "9" in a regularly spaced manner, each of the ten individual numbers being separated from the following individual number by an empty space or a display window arranged at the periphery of the units indicator;
- a tens indicator which carries on a periphery a series of thirty-one regularly spaced numbers, namely nine times in a row the number "0", then ten times in a row the number "1", then ten times in a row the number "2", and finally two times in a row the number "3";
- as the units indicator is arranged above the tens indicator, the tens indicator advancing one step per day and driving the units indicator forward by one step every day, except the day that the date indication display changes from "31" to "01".

As a result of these features, the present invention provides a date display device which includes a limited number of components. This type of device is therefore less expensive and operates more reliably than the prior art devices.

According to additional features of the invention:

- the tens indicator is provided with a toothing of thirty teeth wherein each tooth is placed in correspondence with a number carried by the tens indicator, one area of the tens indicator which bears a given number of the series of thirty-one numbers having no teeth so that, when the second number "3" of the tens indicator, used to form the indication "31" with the number "1" of the units indicator, disappears from the aperture and is replaced by the first number "0" of the series of nine numbers "0" of the tens indicator to form, with the number "1" of the units indicator, the indication "01", the units indicator remains immobile;
- the toothing of thirty teeth extends at the periphery of the tens indicator;
- the tens indicator includes, on a lower level, a toothing formed of thirty-one regularly spaced teeth via which it is driven at a rate of one step per day by a wheel of the watch movement;

- the units indicator is driven by the tens indicator via an intermediate wheel and a units star-wheel whose position is indexed by a jumper-spring;
- the units indicator is mounted on the units star-wheel;
- the units indicator is arranged concentrically above the tens indicator;
- the ten individual numbers from "0" to "9" are arranged on the units indicator in the clockwise direction, and the series of thirty-one numbers is arranged on the tens indicator in the anticlockwise direction;
- the units indicator and the tens indicator are each formed by a ring.

BRIEF DESCRIPTION OF THE DRAWINGS

Other features and advantages of the present invention will appear more clearly from the following detailed description of an embodiment of the date display device according to the invention, this example being given solely by way of non-limiting illustration with reference to the annexed drawing, in which.

DETAILED DESCRIPTION OF THE INVENTION

The present invention proceeds from the general inventive idea which consists in driving the units indicator of a date display device via a tens indicator. The tens indicator drives the units indicator once per day for the first thirty days of the month, the units indicator remaining immobile on the thirty-first day during the date indication change from the indication "31" to the indication "01". The units indicator is arranged above the tens indicator, so that the surface area of the two indicators remains within acceptable dimensions while providing a display of large dimensions.

Figure 1:
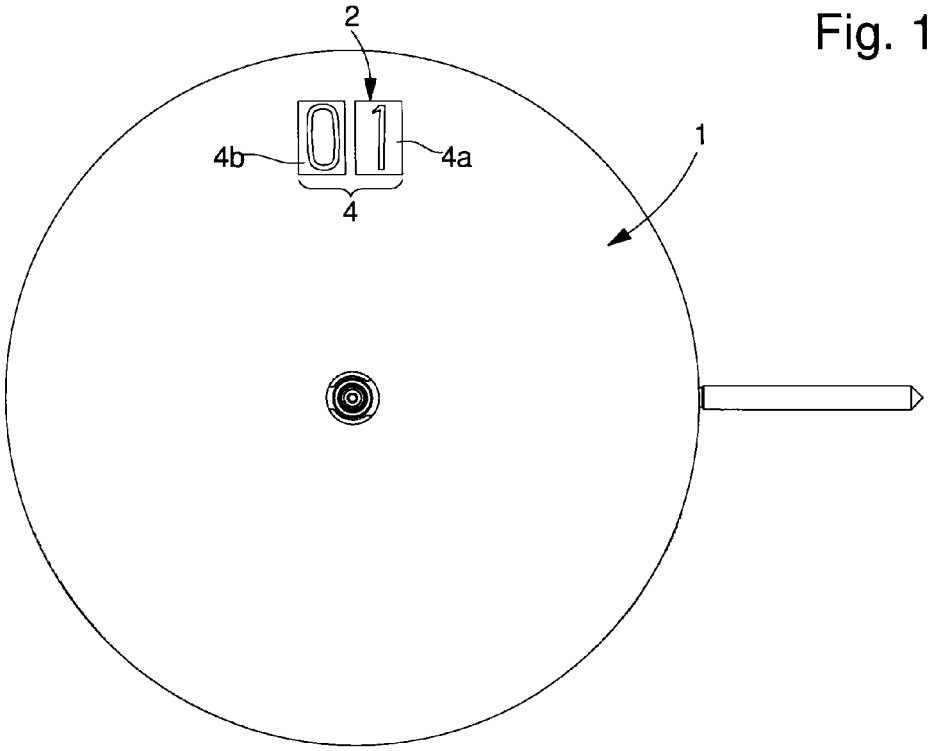
FIG. 1 is a top view of the dial of a timepiece provided with a date display device according to the invention.

FIG. 1 is a top view of the dial of a timepiece provided with a date display device according to the invention. Designated as a whole by the general reference numeral 1, this dial includes an aperture 2 located at midday in the example shown in the drawing and in which a date indication 4 appears. This date indication 4 is formed of a number for the units 4*a* and a number for the tens 4*b*.

Figure 3:
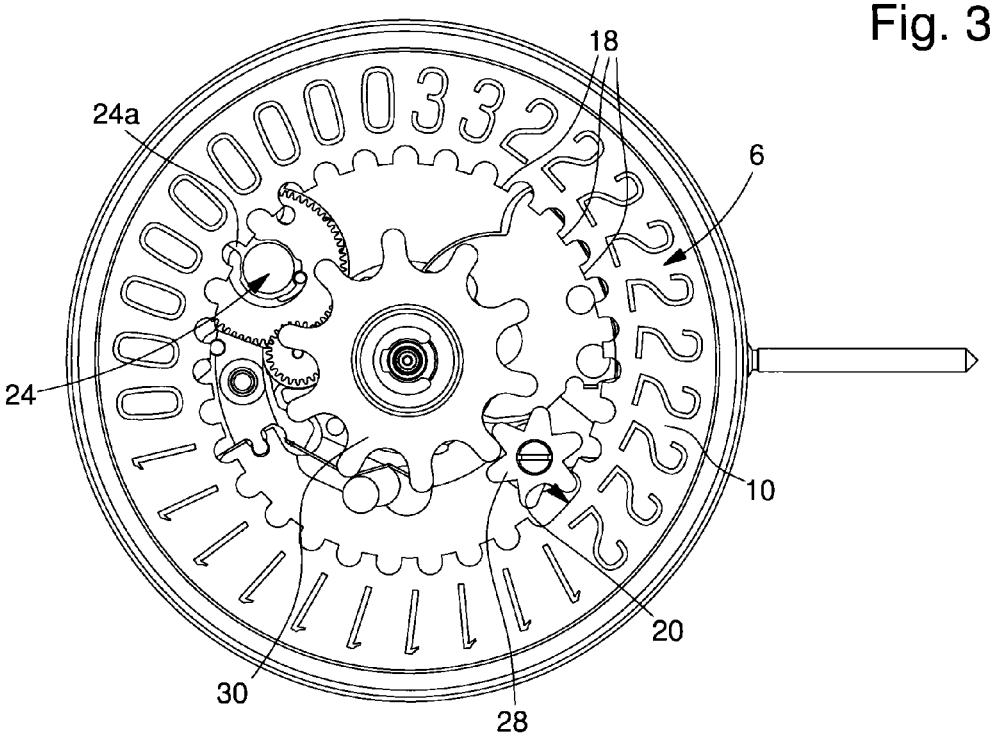
FIG. 3 is a top view of the timepiece of FIG. 1 from which the dial and the units indicator ring have been removed in order to reveal the tens indicator ring.
Figure 2:
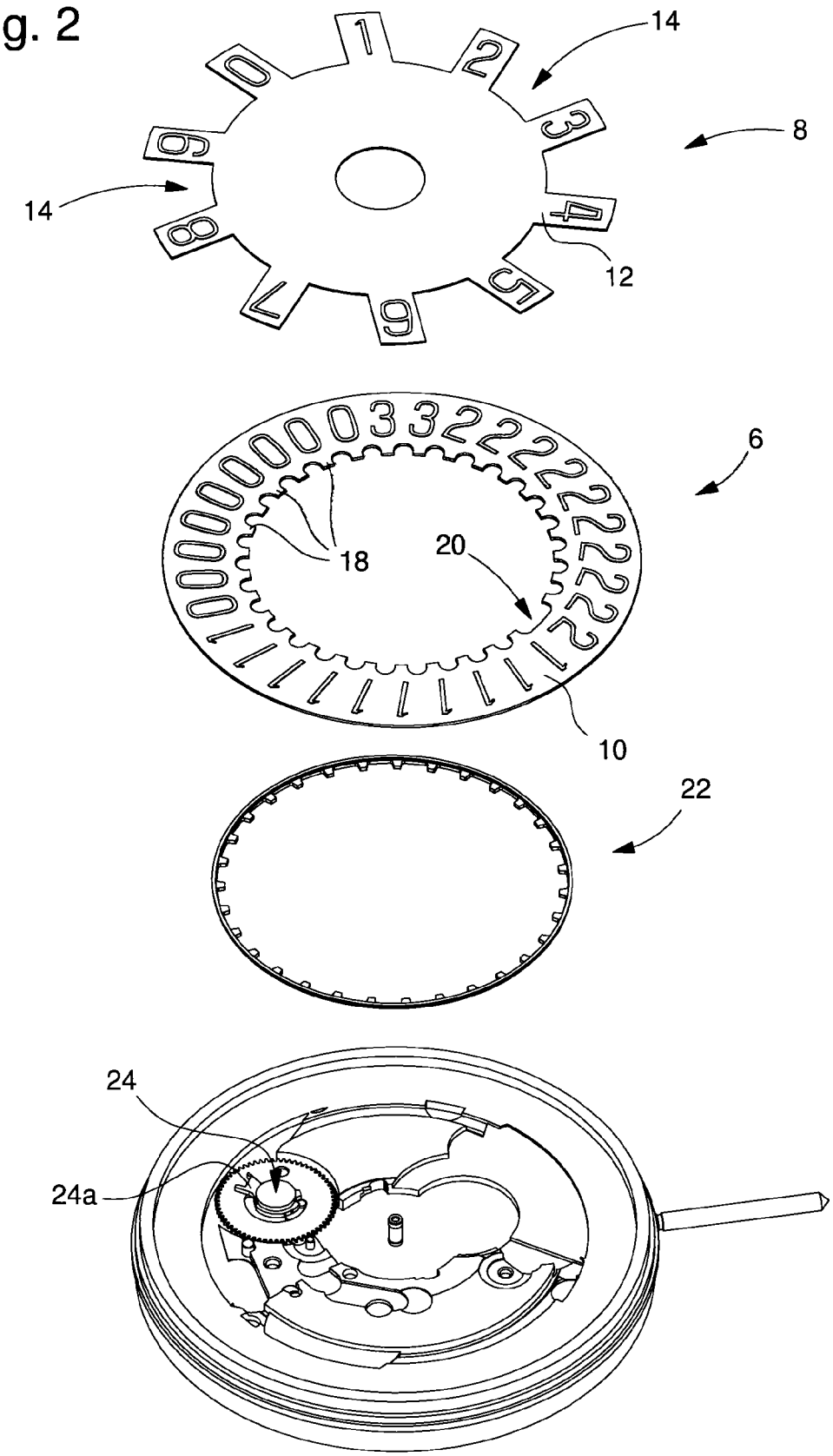
FIG. 2 is a perspective view of the date display device of the invention in an unassembled state.
Figure 4:
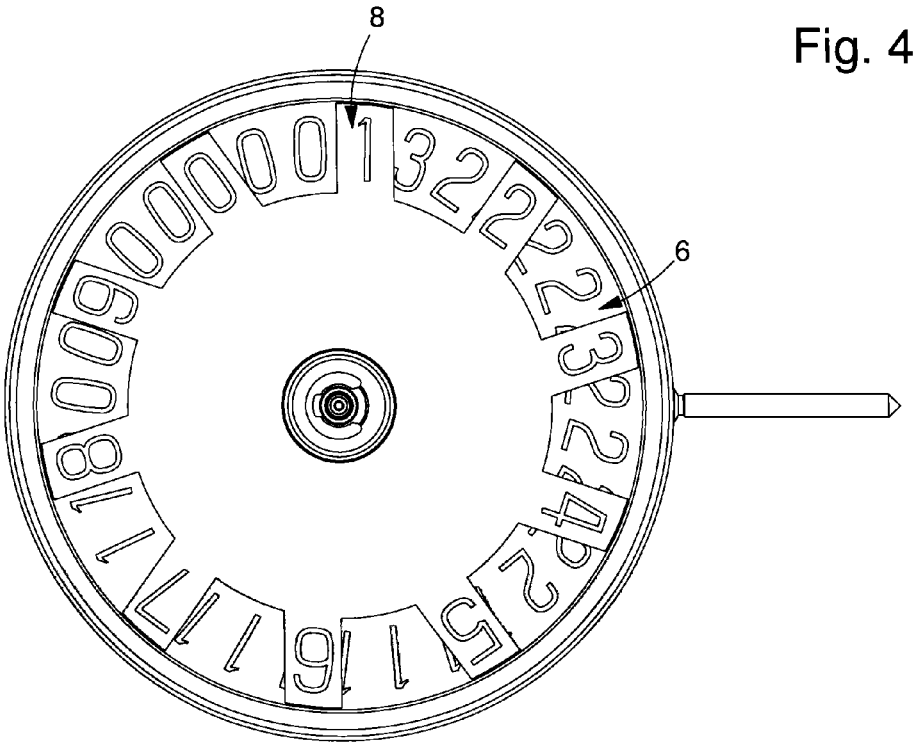
FIG. 4 is a top view of the timepiece of FIG. 3 in which the units indicator ring has been arranged concentrically above the tens indicator ring.

According to the invention, the date display device includes a tens indicator ring 6 and a units indicator ring 8. As can be observed in FIGS. 2 and 3, the tens indicator ring 6 carries on a periphery 10 a series of thirty-one regularly spaced numbers, namely nine times in a row the number "0", then ten times in a row the number "1", then ten times in a row the number "2", and finally two times in a row the number "3". In the example shown in the drawing, the thirty-one numbers carried by the tens indicator 6 follow each other in a regularly spaced manner in an anticlockwise direction. It goes without saying that by means of modifications within the grasp of those skilled in the art, the numbers carried by tens indicator 6 could be distributed in the clockwise direction. Units indicator 8 carries (see in particular FIG. 2) on a periphery 12 the ten individual numbers from "0" to "9" in a regularly spaced manner, each of the ten individual numbers being separated from the following individual number by an empty space 14 arranged at the periphery 12 of the units indicator ring 8. In the example shown in the drawing, the ten individual numbers from "0" to "9" succeed each other in a clockwise direction. Of course, if the numbers carried by tens indicator 6 succeed each other in a clockwise direction, the numbers carried by units indicator 8 succeed each other in an anticlockwise direction. The role of empty spaces 14 is to make it possible to see the indications carried by tens indicator ring 6 when units indicator ring 8 is arranged above tens indicator ring 6. By way of preferred but non-limiting example, units indicator ring 8 is arranged concentrically with respect to tens indicator ring 6. According to a variant embodiment which is not illustrated, the empty spaces 14 could be replaced by display apertures arranged in each case between two successive individual numbers.

Figure 5:
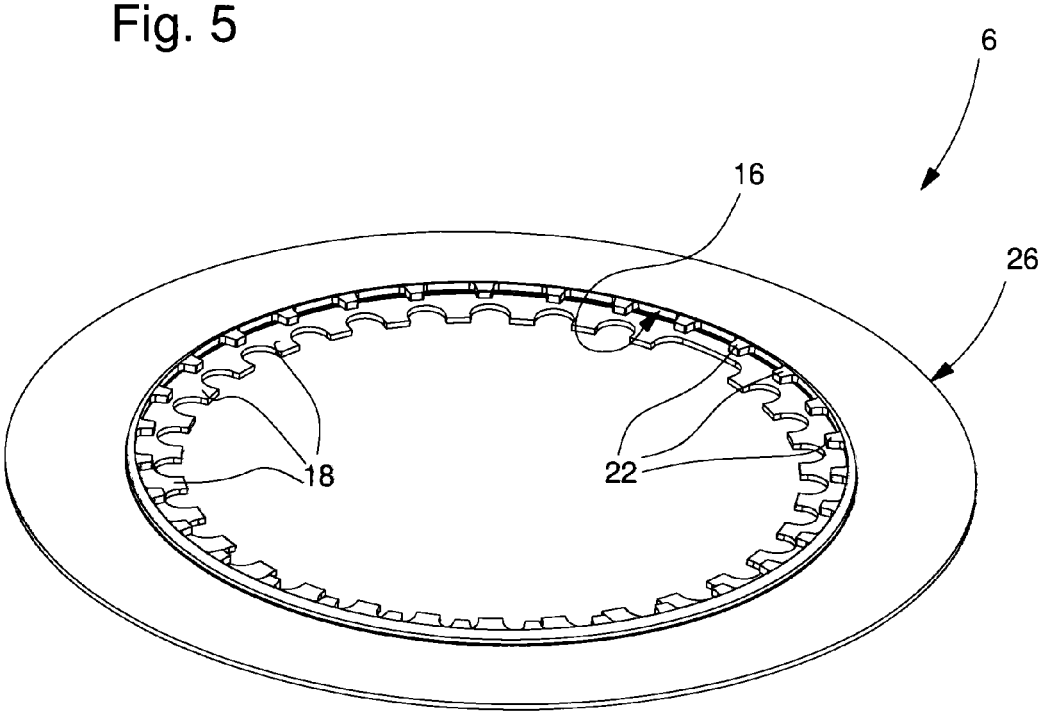
FIG. 5 is a perspective bottom view of the tens indicator ring.

Tens indicator ring 6 includes (see FIG. 5), on an upper level along the inner edge 16 thereof, a first toothing 18 of thirty teeth wherein each of the teeth is placed in correspondence with one of the thirty numbers carried by tens indicator ring 6. According to the invention (see FIG. 2), an area 20 of tens indicator ring 6, which bears a given number of the series of thirty-one numbers, has no tooth so that, when the second number "3" of tens indicator ring 6 used to form the indication "31" with number "1" of units indicator ring 8, disappears from aperture 2 and is replaced by the first number "0" of the series of nine numbers "0" of tens indicator ring 6 to form, with the number "1" of units indicator ring 8, the indication "01", units indicator ring 8 remains immobile. In the example shown in the drawing, area 20 of tens indicator ring 6 which has no tooth, corresponds to the first number "2" of the series of ten numbers "2". It is essential clearly to understand that the location of area 20 of tens indicator ring 6 which has no tooth depends on the position of aperture 2 on dial 1 and on the position of intermediate wheel 28. In the example shown in the drawing, aperture 2 is located at midday on dial 1. It is, however, perfectly possible to arrange aperture 2 at another location on dial 1, for example at three o'clock or at nine o'clock, in which case the location of toothless area 20 of tens indicator ring 6 will have to be modified, so that units indicator ring 8 remains immobile when the indication "31" disappears from aperture 2 and is replaced by the indication "01".

Figure 6:
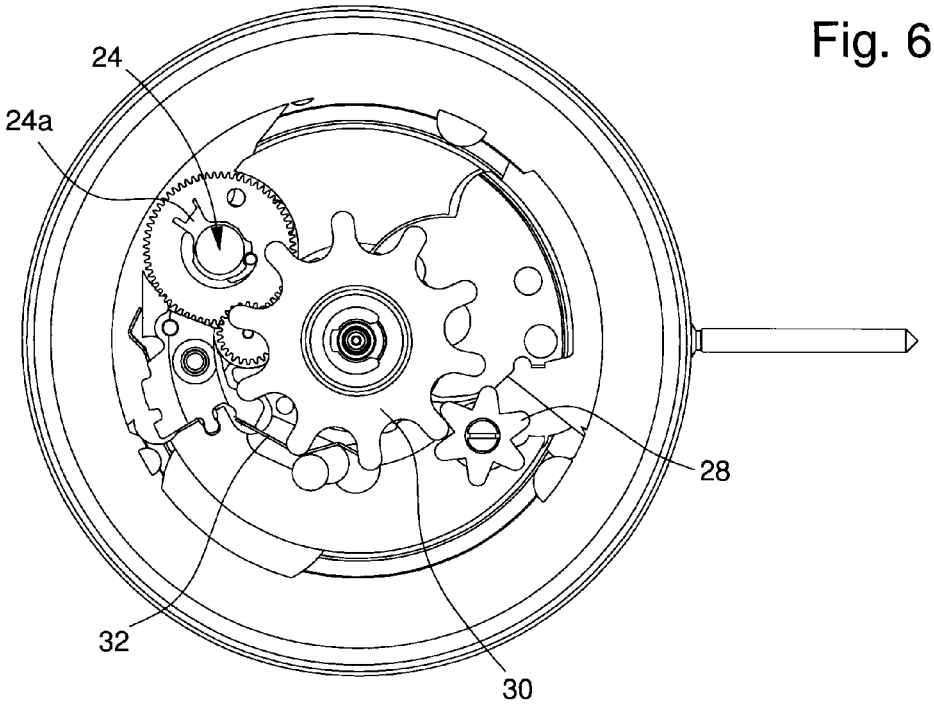
FIG. 6 is a view of the drive wheel which completes one revolution in twenty-four hours and which carries a finger via which it meshes with the second toothing with thirty-one teeth of the tens indicator ring.

Tens indicator ring 6 also includes, on a lower level, a second toothing 22 formed of thirty-one regularly spaced teeth via which it is driven at a rate of one step per day by a wheel 24 of the watch movement. To this end, drive wheel 24 completes one revolution in twenty-four hours and carries (see FIG. 6) a finger 24*a* via which it meshes with the second toothing 22 of tens indicator ring 6. According to a preferred but non-limiting variant of the invention, the second toothing 22 extends along the inner edge 16 of tens indicator ring 6. In the embodiment shown in the drawing, the second toothing 22 takes the form of a part affixed to the bottom of tens indicator ring 6. Of course, it is also possible to envisage making tens indicator ring 6 in one piece with its first and second toothings 18 and 22. According to another non-illustrated variant, the second toothing 22 could be arranged along an outer edge 26.

It is observed that the teeth of second toothing 22 and those of first toothing 18 are in a staggered arrangement, i.e. a tooth of second toothing 22 corresponds to a hollow between two successive teeth of first toothing 18.

In the example shown in the drawing, tens indicator ring 6 rotates in a clockwise direction and drives, via its first toothing 18, an intermediate wheel 28 which also rotates in a clockwise direction and which in turn meshes with a units star-wheel 30 whose position is indexed by a jumper spring 32. The units star-wheel 30 rotates in an anticlockwise direction and carries the units indicator ring 8 which is fixed by any suitable means to units star-wheel 30.

It will be clear from the foregoing that tens indicator ring 6 advances one step per day and, via intermediate wheel 28 and units star-wheel 30, drives units indicator 8 forward by one step per day. This driving is repeated every day, with the exception of the day where the indication "31" disappears from aperture 2 and is replaced by the indication "01". Indeed, on that day, intermediate wheel 28 is opposite area 20 of tens indicator ring 6 which has no tooth, so that tens indicator ring 6 advances one step, whereas intermediate wheel 28, and therefore units indicator ring 8, remain immobile.

It goes without saying that this invention is not limited to the embodiment that has just been described and that various simple modifications and variants can be envisaged by those skilled in the art without departing from the scope of the invention as defined by the annexed claims. It will be understood in particular that the direction in which the numbers are arranged on tens indicator ring 6 and on units indicator ring 8 may be reversed with respect to the above description. In that case, the direction of rotation of units indicator ring 8 and of tens indicator ring 6 will also be reversed. It will also be observed that tens indicator 6 and units indicator 8 are made in the form of two rings. These two indicators 6 and 8 could take the form of two transparent discs on whose surface the various numbers of the tens and units are arranged.

What is claimed is:

1. A device for displaying a date indication in an aperture of a watch dial including:

a units indicator which carries on a periphery the ten individual numbers from "0" to "9" in a regularly spaced manner, each of the ten individual numbers being separated from the following individual number by an empty space or a display aperture arranged at a periphery of the units indicator;

a tens indicator which carries on a periphery a series of thirty-one regularly spaced numbers, namely nine times in a row the number "0", then ten times in a row the number "1", then ten times in a row the number "2", and finally two times in a row the number "3";

wherein the units indicator is arranged above the tens indicator, wherein the tens indicator advances one step per day and drives the units indicator forward by one step every day, except the day that the date indication display changes from "31" to "01".

2. The display device according to claim 1, wherein the tens indicator is provided with a first toothing formed of thirty teeth wherein each tooth is placed in correspondence with one of the numbers carried by the tens indicator, wherein one area of the tens indicator which bears a given number of the series of thirty-one numbers has no tooth so that, when the second number "3" of the tens indicator, used to form the indication "31" with the number "1" of the units indicator, disappears from the aperture and is replaced by the first number "0" of the series of nine numbers "0" of the tens indicator to form, with the number "1" of the units indicator, the indication "01", the units indicator remains immobile.

3. The display device according to claim 2, wherein the tens indicator includes a second toothing formed of thirty-one regularly spaced teeth via which the tens indicator is driven at a rate of one step per day by a wheel of the watch movement.

4. The display device according to claim 3, wherein the second toothing of thirty-one teeth and the first toothing of thirty teeth extend along an inner edge of the tens indicator, wherein the second toothing of thirty-one teeth is formed on a lower level of the tens indicator, and wherein the first toothing of thirty teeth is formed on an upper level of the tens indicator.

5. The display device according to claim 4, wherein the units indicator is driven by the tens indicator via an intermediate wheel and a units star-wheel whose position is indexed by a jumper-spring.

6. The display device according to claim 5, wherein the units indicator is mounted on the units star-wheel.

7. The display device according to claim 4, wherein the teeth of the second toothing of thirty-one teeth and the teeth of the first toothing of thirty teeth are in a staggered arrangement, wherein a hollow between two successive teeth of the first toothing of thirty teeth corresponds to a tooth of the second toothing of thirty-one teeth.

8. The display device according to claim 7, wherein the units indicator is driven by the tens indicator via an intermediate wheel and a units star-wheel whose position is indexed by a jumper-spring.

9. The display device according to claim 8, wherein the units indicator is mounted on the units star-wheel.

10. The display device according to claim 3, wherein the second toothing of thirty-one teeth extends along an outer edge of the tens indicator.

11. The display device according to claim 10, wherein the units indicator is driven by the tens indicator via an intermediate wheel and a units star-wheel whose position is indexed by a jumper-spring.

12. The display device according to claim 11, wherein the units indicator is mounted on the units star-wheel.

13. The display device according to claim 3, wherein the units indicator is driven by the tens indicator via an intermediate wheel and a units star-wheel whose position is indexed by a jumper-spring.

14. The display device according to claim 13, wherein the units indicator is mounted on the units star-wheel.

15. The display device according to claim 1, wherein the units indicator is arranged concentrically above the tens indicator.

16. The display device according to claim 1, wherein the ten individual numbers from "0" to "9" are arranged on the units indicator in a clockwise direction, and wherein the series of thirty-one numbers is arranged on the tens indicator in an anticlockwise direction.

17. The display device according to claim 1, wherein the units indicator and the tens indicator are each formed by a ring.

* * * * *